US007793472B2

(12) United States Patent
Dries

(10) Patent No.: US 7,793,472 B2
(45) Date of Patent: Sep. 14, 2010

(54) MOUNTING ASSEMBLY FOR ADJUSTABLY MOUNTING FRAME PARTS ONTO WALL OR INTO WALL OPENING, ENABLING POSITIONAL ADJUSTMENT OF FRAME PART IN MULTIPLE DIRECTIONS

(75) Inventor: Rudi Dries, Schilde (BE)

(73) Assignee: Liexco S.A., Luxembourg (LU)

( * ) Notice: Subject to any disclaimer, the term of this patent is extended or adjusted under 35 U.S.C. 154(b) by 1076 days.

(21) Appl. No.: 11/319,139

(22) Filed: Dec. 27, 2005

(65) Prior Publication Data

US 2006/0156686 A1 Jul. 20, 2006

(30) Foreign Application Priority Data

Dec. 28, 2004 (EP) ..... 04447296

(51) Int. Cl.
*E06B 1/04* (2006.01)

(52) U.S. Cl. ..... 52/214; 248/284.1

(58) Field of Classification Search ..... 52/213, 52/214, 217, 718.04, 718.06, 718.07; 248/306.7, 248/288.31, 291.1, 284.1, 316.7, 343, 344, 248/346.06, 349.1
See application file for complete search history.

(56) References Cited

U.S. PATENT DOCUMENTS 1,386,959 A * 8/1921 Severance et al. ..... 248/481
1,926,673 A * 9/1933 Gregg ..... 52/211
3,477,678 A * 11/1969 Icke et al. ..... 248/288.31
3,681,881 A * 8/1972 Baran ..... 52/29
3,685,226 A * 8/1972 Richter ..... 52/217
3,999,339 A * 12/1976 Sappenfield ..... 52/98
4,038,801 A 8/1977 Busch et al.
4,251,962 A * 2/1981 Langenhorst ..... 52/127.7
5,477,644 A * 12/1995 Chenoweth, Jr. ..... 52/126.1
5,544,456 A * 8/1996 Dries ..... 52/204.1
5,960,865 A * 10/1999 Costa et al. ..... 165/86
6,196,081 B1 * 3/2001 Yau ..... 74/479.01
6,328,270 B1 * 12/2001 Elberbaum ..... 248/288.31
6,691,461 B1 * 2/2004 Gitkin ..... 49/74.1
7,028,961 B1 * 4/2006 Dittmer et al. ..... 248/278.1
7,331,146 B1 * 2/2008 Beutler et al. ..... 52/204.56
7,455,271 B2 * 11/2008 Pincek et al. ..... 248/288.31
7,506,851 B1 * 3/2009 Tooze ..... 248/233
2001/0023557 A1 * 9/2001 Graham ..... 49/504
2005/0056751 A1 * 3/2005 Slatter ..... 248/288.11

(Continued)

FOREIGN PATENT DOCUMENTS

DE 199 00 095 C1 3/2000

*Primary Examiner*—Gay Ann Spahn
(74) *Attorney, Agent, or Firm*—Novak Druce + Quigg LLP; Jerold I. Schneider

(57) ABSTRACT

Mounting assembly for adjustably mounting a frame part, such as for example a reveal part of a door frame or window frame or the like, onto a wall or onto a reveal wall of a wall opening. The mounting assembly comprises a holder element having attachment member on which the frame part can be attached and adjustment member for adjusting the orientation of the holder element with respect to the reveal wall, and a fixing element for fixing the holder element onto the reveal wall. The mounting assembly comprises a single fixing element which is provided for fixing the holder element on a single location to the reveal wall. The fixing element comprises a pivot which enables the holder element to pivot with respect to the reveal wall.

19 Claims, 11 Drawing Sheets

U.S. PATENT DOCUMENTS

2005/0104490 A1* 5/2005 Mittag et al. ..... 312/326
2005/0120631 A1* 6/2005 Sanders ..... 49/367
2005/0236543 A1* 10/2005 O'Neil ..... 248/286.1
2005/0269466 A1* 12/2005 Conway et al. ..... 248/222.14
2006/0185252 A1* 8/2006 Dries ..... 49/460
2006/0231711 A1* 10/2006 Shin ..... 248/291.1
2007/0246626 A1* 10/2007 Reynolds ..... 248/281.11
2009/0025320 A1* 1/2009 Wagner et al. ..... 52/217

* cited by examiner

MOUNTING ASSEMBLY FOR ADJUSTABLY MOUNTING FRAME PARTS ONTO WALL OR INTO WALL OPENING, ENABLING POSITIONAL ADJUSTMENT OF FRAME PART IN MULTIPLE DIRECTIONS

FIELD OF THE INVENTION

The present invention relates to a mounting assembly for adjustably mounting a frame part, such as for example a reveal part of a door frame or window frame or the like, onto a wall or into a wall opening.

BACKGROUND OF THE INVENTION

In building constructions it is common that the walls have irregular surfaces, do not extend perpendicular or parallel with respect to each other, the floor, the ceiling etc. Similarly it often happens that the side faces delimiting an opening in a wall, i.e. the reveal walls, have irregular surfaces or are not perfectly perpendicular to the top face of the opening or the floor, or one or more of the adjacent wall faces of the wall in which the opening is located. The wall opening can be any kind of opening in a wall, such as for example a door opening, a window opening, a garage door opening, a gate opening etc. The irregularities can hamper a proper positioning of for example the stiles of a frame in these wall openings and consequently can hamper a proper positioning of a panel or object, such as a door panel, a window, a garage door panel etc., onto the frame. For example in the case of a door frame, a proper vertical positioning of the vertical reveal part of the door frame is essential to allow for a proper positioning of the door within the frame. The latter is not only important from an aesthetical point of view, but also contributes to a better over-all functioning.

A mounting assembly for adjustably mounting a frame part to a side face of a wall opening is for example known from DE-C1-19900095. The disclosed mounting assembly is fixed in width direction onto a reveal wall of a wall opening and is provided for holding two complementary door frame parts. The mounting assembly comprises an anchoring plate with a pair of adjusting bolts, by means of which the position of the anchoring plate and thus the frame parts can be adjusted in one direction with respect to the reveal wall. More particularly, the mounting assembly enables a correction of the orientation of the frame parts by a slight tilt about the height axis. Apart from that, the presence of a plurality of anchoring plates also allows adjusting the position of the frame parts in height direction with respect to the reveal wall.

However, the mounting assembly known from DE-C1-19900095 has the disadvantage that it does not enable an adjustment of the position of the frame part with respect to the reveal wall to overcome all irregularities or deviations which may occur.

It is therefore an object of this invention to provide a mounting assembly with which the adjustability of the position of the frame part with respect to the reveal wall is enhanced.

This is achieved according to the present invention with the technical features of the characterising part of the claims.

SUMMARY OF THE INVENTION

The mounting assembly of the invention comprises an holder element on which the frame part is attached and a fixing element by means of which the holder element is fixed to the reveal wall. The holder element is equipped with adjustment means such as for example set screws by means of which the orientation of the frame part, which is fixed onto the holder element, with respect to the reveal wall can be adjusted. The mounting assembly of the invention has a single fixing element, which furthermore comprises a pivot which enables the holder element to pivot with respect to the reveal wall. This arrangement ensures that the orientation of the frame part can be sufficiently adjusted.

An analysis of the problem of the prior art mounting assembly has shown that the problem is partly caused by the fact that the mounting assembly is fixed to the reveal wall on two spaced apart locations. This limits the extent to which the mounting assembly can be tilted with respect to the reveal wall. In the mounting assembly of the invention, this limit is removed by applying only one fixing element for fixing the assembly to the reveal wall. Furthermore, by providing the pivot which enables the holder element to pivot with respect to the fixing element, the adjustability of the orientation of the holder element with respect to the reveal wall is severely enhanced.

The mounting assembly of the invention preferably comprises adjustment means on at least three spaced apart locations at the periphery of the holder element. This ensures that the holder element can be tilted in all directions with respect to the fixing element and the reveal wall. The fixing element is preferably located substantially in the centre of the holder element, i.e. as far as possible from the locations where the adjustment means are provided. This ensures that the tilting of the holder element can be effected to a large extent. This whole arrangement can ensure a maximum adjustability of the orientation of the holder element with respect to the reveal wall.

The holder element of the mounting assembly of the invention preferably has an inner part which carries the attachment means for attaching the frame part and which movably engages the fixing part in such a way that the inner part enables an adjustment in distance towards the reveal wall. By means of this arrangement, the distance between the attachment means and the reveal wall, and thus the distance between the frame part attached to the mounting assembly and the reveal wall can be adjusted, at least to a small extent. This adds an additional degree of freedom to the mounting assembly of the invention, so that substantially all the surface irregularities which the reveal wall may have can be overcome.

For bridging larger distances between the frame part and the reveal wall, the mounting assembly of the invention may further comprise one or more spacer elements in a flexible material, which are provided for placement between the holder element and the reveal wall. The flexibility of the spacer elements helps to overcome small surface irregularities of the reveal wall and to dampen vibrations, leading to a more rigid attachment of the frame part to the reveal wall.

The invention further relates to a frame assembly comprising the mounting assembly as described above, at least one frame part for being attached to the mounting assembly, and possibly also stiles for being fixed on the frame part and closing the frame around the reveal wall.

BRIEF DESCRIPTION OF THE DRAWINGS

The invention will be further elucidated by means of the following description and the appended figures.

Figure 9:
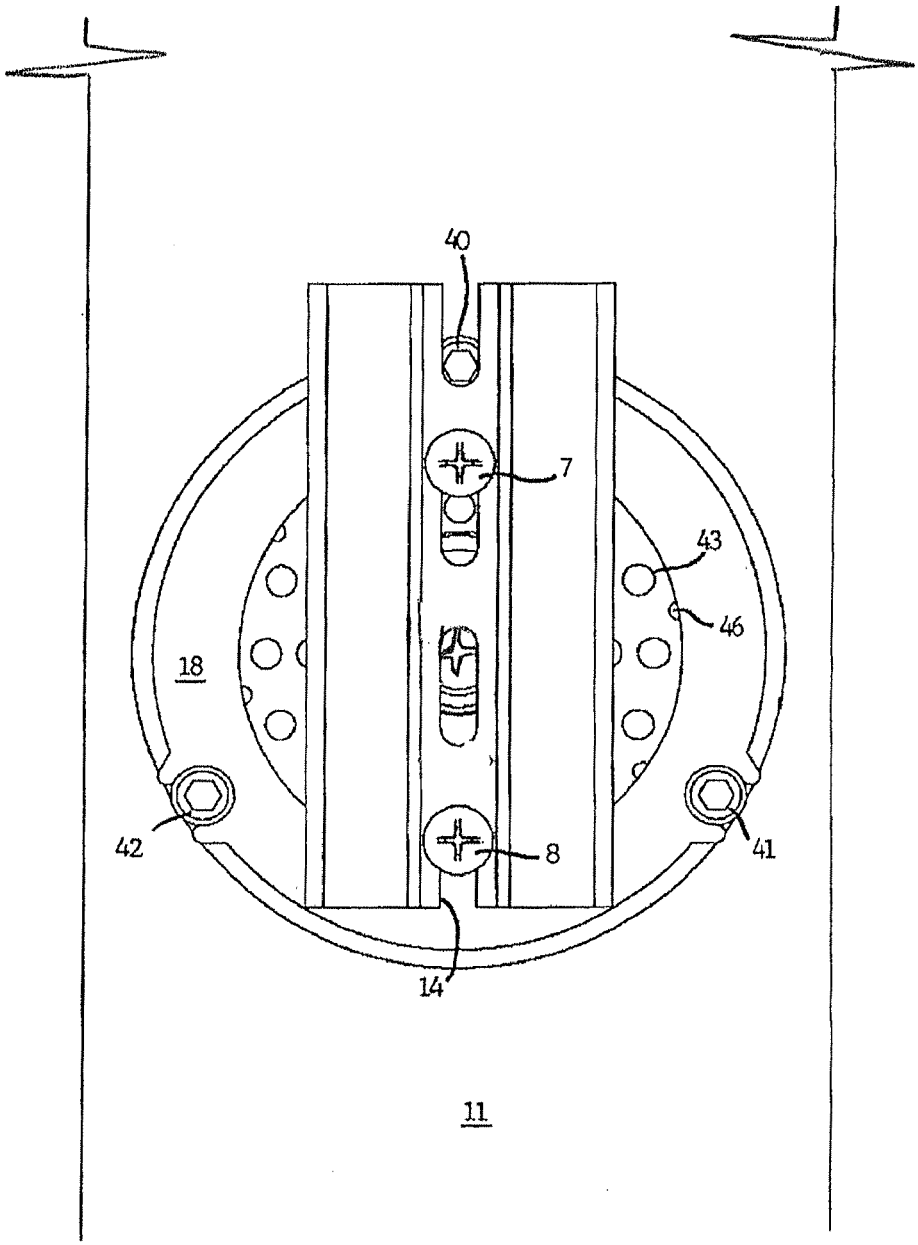
Figure 10:
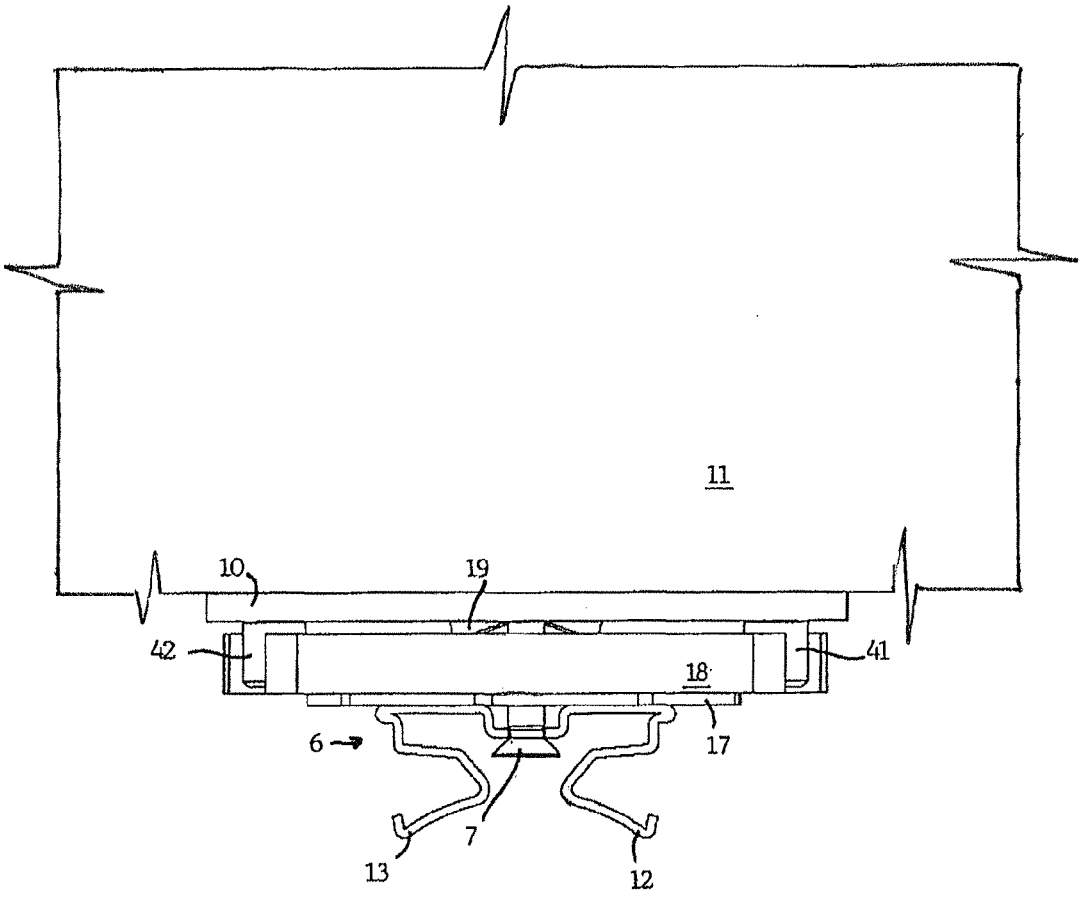
Figure 11:
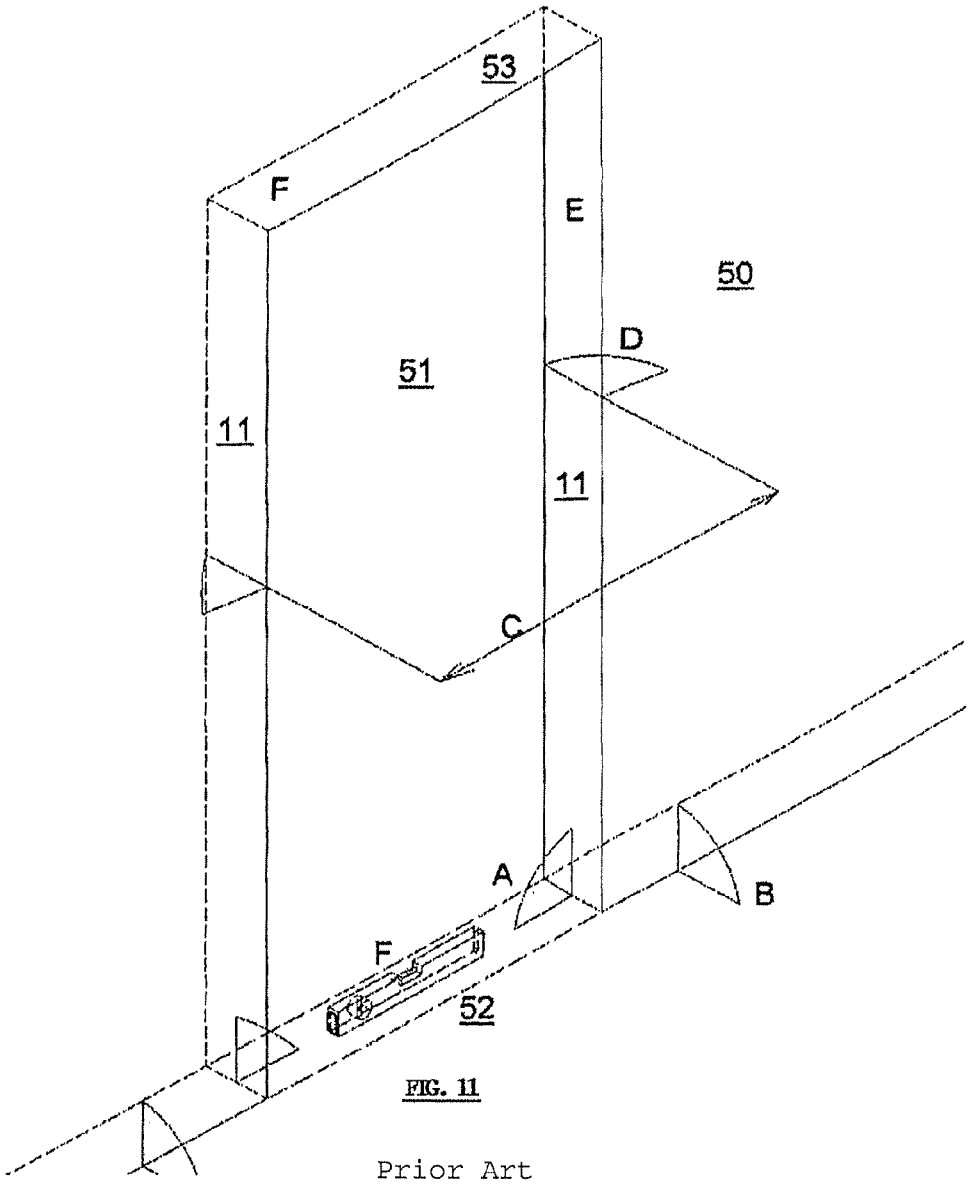
FIG. 11 Prior Art
FIG. 11 indicates the possible irregularities or diversions which occur on walls or in wall openings of building structures.

The mounting assemblies 1, 15 shown in FIGS. 1-10 are intended to overcome irregularities or diversions which occur in wall surfaces or wall opening surfaces. The possible irregularities or diversions are summarised in FIG. 11 and may include:

A: the reveal walls 11 of the wall opening 51 are not exactly perpendicular with respect to the floor 52, B: the wall plane 50 in which the wall opening 51 is located is not exactly vertical, C: the opposing reveal walls 11 are not exactly parallel to each other, D: the reveal walls 11 are not exactly perpendicular to the wall plane 50, E: the reveal walls 11 have an irregular or uneven surface, F: the floor 52 or the top wall 53 of the wall opening 51 are not level.

In the other figures, arrows A-F indicate how these irregularities or diversions are overcome by the mounting assemblies 1, 15. The walls or construction elements onto which the mounting assemblies 1, 15 are mounted may be of any material known to the person skilled in the art, such as for example brick, concrete, steel, wood etc.

DETAILED DESCRIPTION OF THE INVENTION

Figure 1:
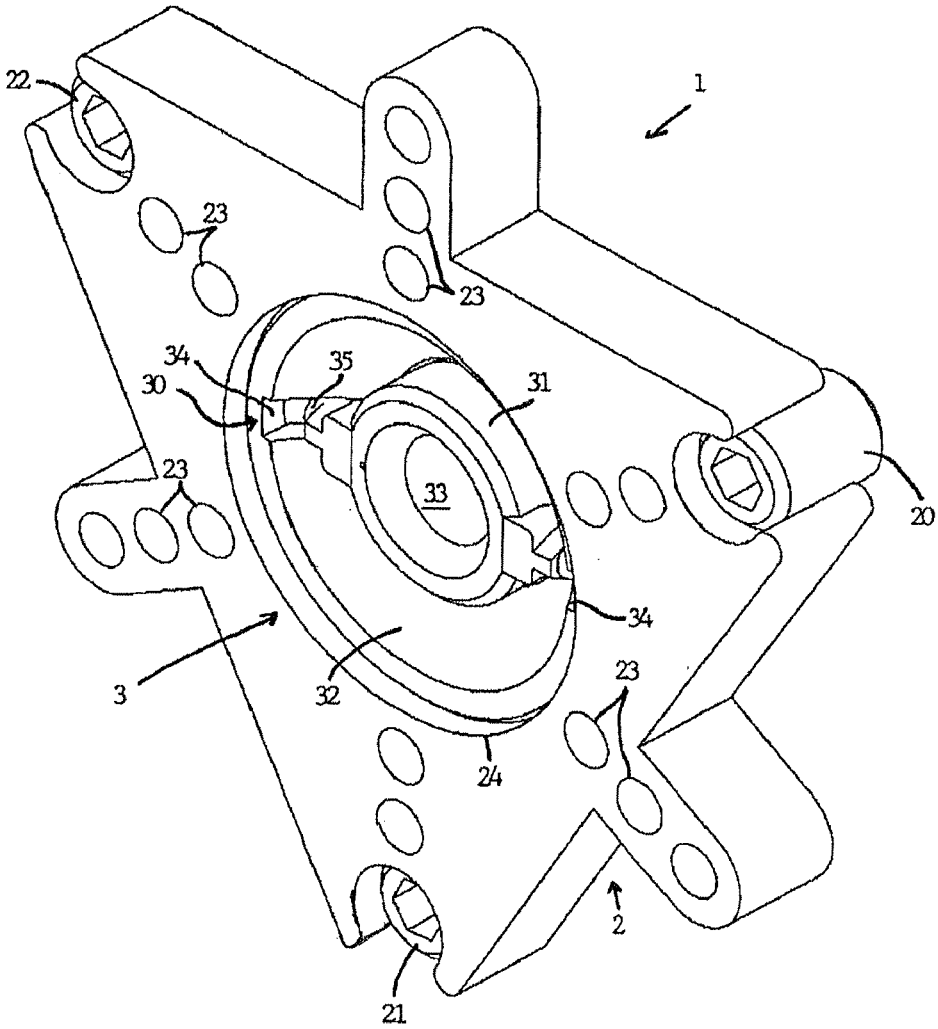
FIG. 1 shows a perspective view of a first preferred embodiment of the mounting assembly of the invention.

The mounting assembly 1 shown in FIG. 1 comprises a holder element 2 which is provided for carrying a reveal part 6 of a door/window frame or the like and a fixing element 3 for fixing the assembly 1 at one single location to a reveal wall 11 of a wall opening. The fixing element 3 is provided with a pivot 30, which enables the holder element 2 and the frame part 6 attached thereto to pivot or tilt with respect to the reveal wall 11. Because of this pivot and the single fixing location, the orientation of the holder element 2 can be adjusted to a large extent.

The fixing element 3 is composed of a number of parts: two concentric elements 31 and 32 which together form the pivot 30, a plug 4 which is inserted through a central opening 33 in the inner concentric element 32 into a hole drilled into the reveal wall 11, and a fixing screw 5 which is screwed into the plug 4 for fixing the whole to the reveal wall 11. The central opening 33 is widened at the front for accommodating the head of the fixing screw 5, which ensures that the parts of the fixing element 3 are indeed fixed to the wall 11 and also that the screw head is substantially flush with the front surface of the fixing element 3. The pivot 30 of the fixing element 3 is formed by a pair of opposite sleeves 34 in the outer concentric element 32 and a pair of opposite ball-shaped protrusions 35 on the inner concentric element 31. Due to the round shape of the protrusions 35, the outer concentric element 32 can pivot about the axis which connects the protrusions 35. The outer concentric element 32 is bowl-shaped, i.e. concave with respect to the front surface. The sleeves 34 follow the bowl-shape of the outer element 32, i.e. they form recessed parts with respect to the front surface of the outer element 32 which slant towards each other from front to back. Due to this shape and the fact that the ball-shaped protrusions are slidably carried by the sleeves 34, the outer concentric element 32 can also tilt about a second axis, perpendicular to the one connecting the protrusions 35 with respect to the inner concentric element 31. The inner concentric element 31 is provided with a peripheral sleeve 36 for accommodating the inner edge of the outer concentric element 32, so that the sliding of the ball-shaped protrusions 35 in the sleeves 34 is not hampered by contact between the concentric elements 31 and 32. So in short, the pivot 30 shown in FIG. 1 makes it possible to tilt the outer concentric element 32 and the holder element 2 mounted thereon about two orthogonal axes with respect to the inner concentric element 31 and the reveal wall 11 to which this is fixed. As a result, the pivot 30 highly enhances the adjustability of the mounting assembly 1.

It is clear that the construction of the pivot 30 can be varied to a large extent. For example the ball-shaped protrusions may be provided on the outer concentric element 32 and the sleeves on the inner concentric element 31.

The outer concentric element 32 has a threaded circumference 37, which corresponds to a threaded circular opening 24 in the holder element 2, so that these two parts engage each other in a screw-like manner. As a result, by rotating the holder element 2 with respect to the outer concentric element 32 of the fixing element 3, the distance of the holder element 2 with respect to the reveal wall 11 can be adjusted or fine-tuned in a continuous manner.

Figure 2:
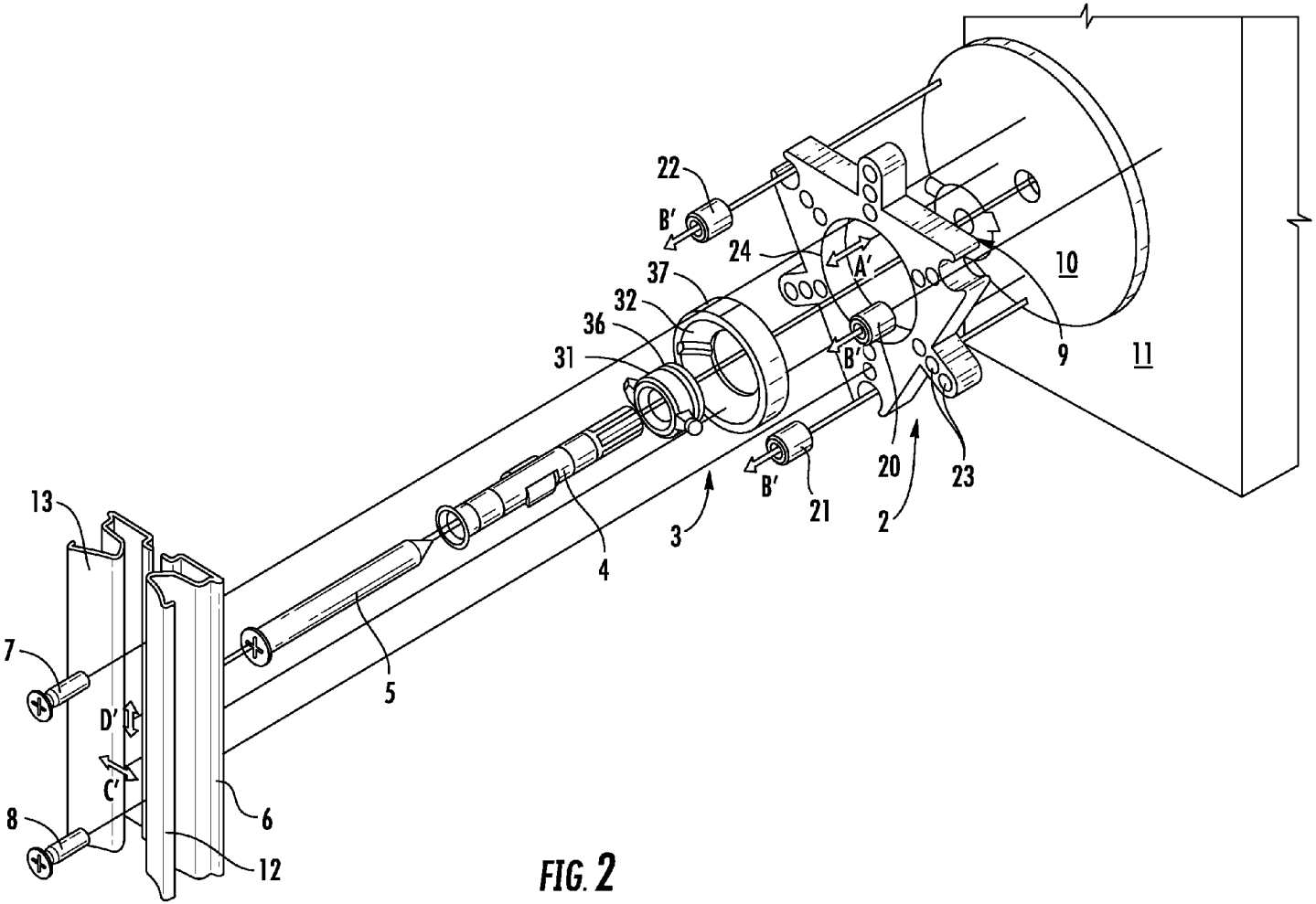
FIG. 2 shows an exploded view of the mounting assembly of FIG. 1.

For adjusting the orientation of the holder element 2 with respect to the reveal wall 11, adjustment means are provided in the form of set screws 20, 21, 22. These are located at the periphery of the holder element 2, i.e. as far as possible from the centre, where the fixing element 3 is located, so that the turning of the set screws has the largest possible effect. In order to obtain adjustability of the orientation around both a horizontal and a vertical axis (or both orthogonal axes enabled by the pivot 30), the set screws 20, 21, 22 are located at three spaced apart locations, more particularly on the corners of an equilateral triangle, which is also substantially the shape of the holder element 2 of FIG. 1. Of course, set screws may also be provided on four or more spaced apart locations around the periphery of the holder element 2, which may have a triangular, rectangular, circular, oval, square, pentagonal, hexagonal or any other shape which is deemed suitable by the person skilled in the art. In the embodiment of FIG. 2, the set screws 20-22 are socket screws whose length is substantially equal to the thickness of the holder element 2, which has the advantage that in use no part of the screws 20-22 protrudes from the surface of the holder element 2. However, shorter or longer socket screws and other than socket screws may also be employed as set screws and other orientation adjustment means are also possible.

For attaching the frame part 6 to the holder element 2, the latter has a plurality of threaded holes 23 spread over its surface for receiving attachment screws 7, 8. The number and location of the threaded holes 23 is such that there is always at least one hole 23 in a position suitable for attaching the frame part 6 in the desired position with respect to the reveal wall 11. In the embodiment of FIG. 1, the holes 23 are located along the bisectors of the corners of the equilateral triangle, which is defined by the set screws 20-22, and along the perpendicular bisectors of the sides of this triangle. In other words, the holes 23 are located on lines running through the centre of the assembly 1 and enclosing an angle of 60° between them. This ensures that the holder element 2 is in a suitable position for attaching the frame part 6 every 60° of a revolution around the fixing element 3. A smaller rotation of the inner holder element 2 may be used for adjustments of the frame part 6 in height and width directions, since the rotation moves the holes 23 or makes different holes 23 available for receiving the screws 7, 8. Naturally, more or less holes 23 may be provided over the surface of the holder element 2.

The fixing of a frame part 6 to a reveal wall 11 using the mounting assembly 1 is clarified with reference to FIG. 2 as follows. First, a hole (not shown) is drilled in the reveal wall 11 for receiving the plug 4 and the fixing screw 5. The plug 4 is inserted into this hole while respectively mounting the inner concentric element 31, the outer concentric element 32, a resilient element 9 and one or more spacer elements 10 over the plug 5. The resilient element 9 functions to apply a spring force to the back of the outer concentric element 32 for maintaining contact between the sleeves 34 and the protrusions 35 during assembly. The number of spacer elements 10 which is mounted is varied according to the distance between the reveal wall 11 and the location where the frame part 6 is to be attached. It is preferred to mount at least one spacer element 10 in a flexible material for overcoming surface irregularities of the reveal wall 11, but if desired the spacer elements 10 can be dispensed with if the distance which can be bridged by rotating the holder element 2 on the fixing element 3 is sufficient. The spacer element 10 is preferably constructed in a flexible material, so that the spacer element 10 not only functions as spacer but also for overcoming the surface irregularities on the reveal wall 11 and for damping vibrations, leading to a much more rigid attachment of the mounting assembly 1 to the reveal wall 11.

After the plug 5 has been inserted, the fixing screw 5 is screwed into the plug 4 until the head of the screw 5 is in contact with the front surface of the first concentric element 31, thereby fixing this element 31 and in turn the outer concentric element 32, the resilient element 9 and the spacer elements 10 (if any) to the reveal wall 11.

Figure 3:
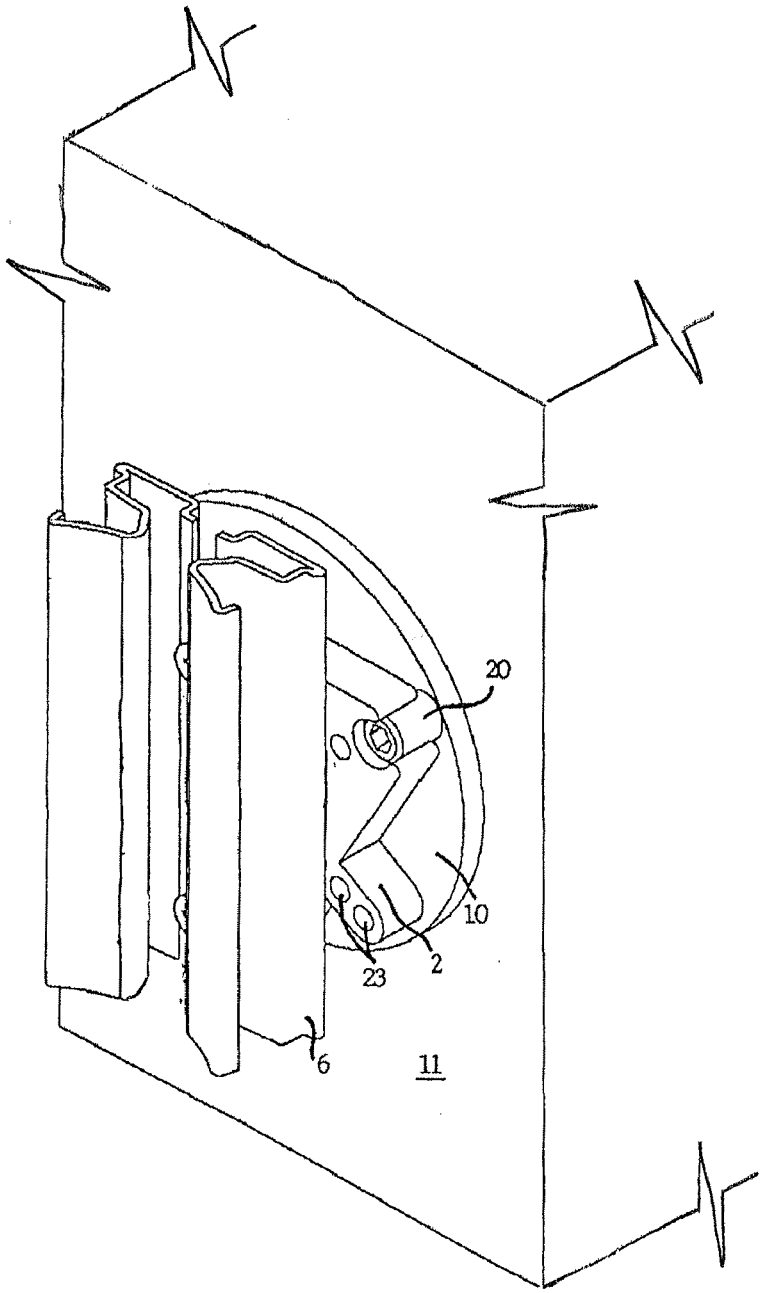
FIGS. 3, 4 and 5 respectively show a perspective view, a side view and a top view of a frame part fixed to a reveal wall by means of the mounting assembly of FIG. 1.
Figure 4:
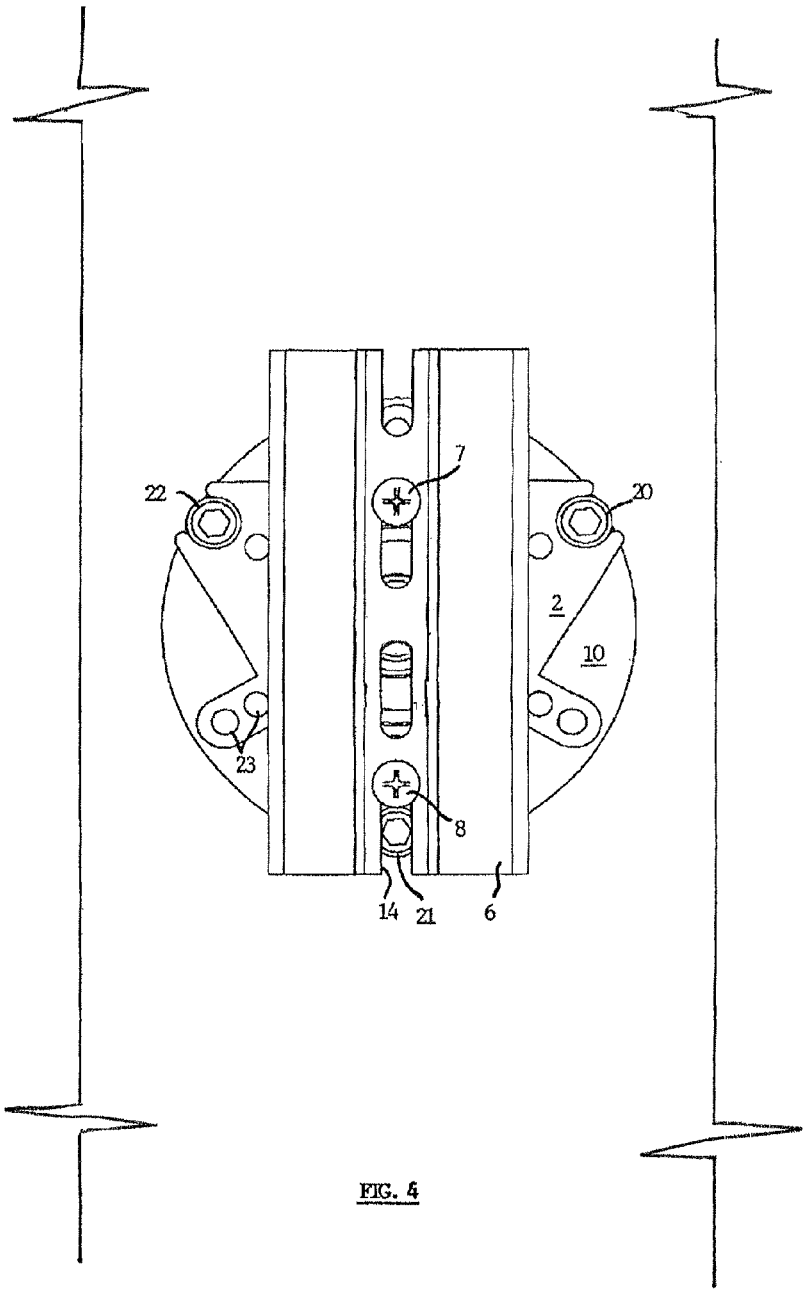
Figure 5:
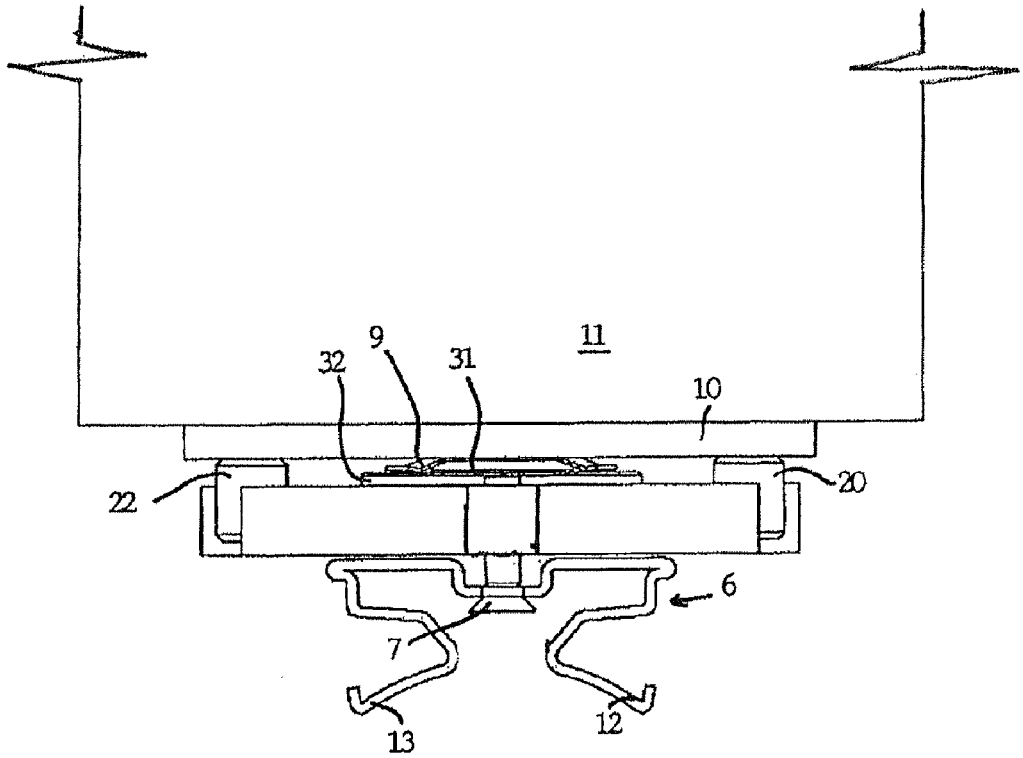

In a next step, the holder element 2 is placed by screwing it onto the outer concentric element 32 up to a position in which its front surface substantially corresponds to the location or distance from the reveal wall 11 at which the frame part 6 is to be mounted. The orientation of the holder element 2 is then adjusted to the desired position by rotating the set screws 20-22. During this operation, the outer concentric element 32 may be moved with respect to the inner concentric element 31 by tilting about the orthogonal pivot axes which are enabled by the pivot 30. The desired distance between the front surface of the holder element 2 and its orientation can be checked by means of any suitable measurement device known to the person skilled in the art. Finally the frame part 6 is attached to the holder element 2 by means of one or more attachment screws 7, 8. The result is shown in FIGS. 3-5.

Figure 6:
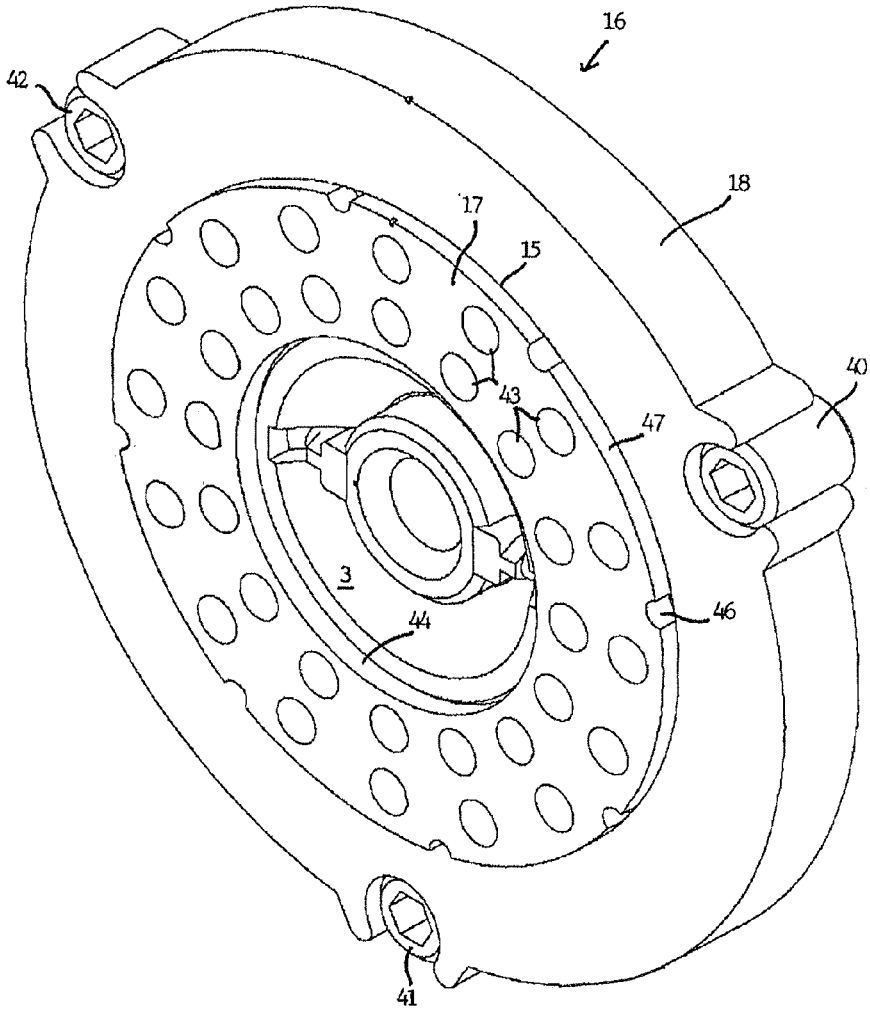
FIG. 6 shows a perspective view of a second preferred embodiment of the mounting assembly of the invention.

The mounting assembly 15 shown in FIG. 6 also comprises a holder element 16 for carrying a reveal part 6 of a door/window frame or the like and a fixing element 3 for fixing the assembly 15 at one single location to a reveal wall 11 of a wall opening. The fixing element 3 of the mounting assembly 15 of FIG. 6 is substantially the same as that of the mounting assembly 1 of FIG. 1 and will therefore not be described in further detail here.

The holder element 16 of FIG. 6 comprises an inner part 17 and an outer part 18. The inner part 17 is formed by an inner ring with holes 43 for receiving attachment screws 7, 8 by which the frame part 6 is attached. The outer part 18 is formed by an outer ring with set screws 40, 41, 42 for adjusting the orientation of the holder element 16 with respect to the reveal wall 11. The inner ring 17 has a first threaded opening 44 for receiving the complementary threaded circumference 37 of the fixing element 3, so that a first screw-like engagement exists between the fixing element 9 and the inner ring 17. The outer ring 18 has a second threaded opening 45 for receiving the inner ring 17, which has a complementary threaded circumference 47 for achieving a second screw-like engagement between the inner ring 17 and the outer ring 18. The threads in the first opening 44 progress oppositely with respect to the threads in the second opening 45, i.e. the first and second openings 44 and 45 may respectively have a right-handed and a left-handed screw thread or vice versa. In other words, the threads in the first and second openings 44 and 45 and on the first and second circumferences 37 and 47 are such that the first screw-like engagement is substantially opposite to the second screw-like engagement. This has the advantage that the inner ring 17 can be rotated around the fixing element 3 without moving the outer ring 18. Since the attachment holes 43 are located on the inner ring 17 and the set screws 40-42 on the outer ring 18, the distance between the plane where the frame part 6 is to be attached and the reveal wall 11 can be adjusted without affecting the orientation of this plane. As a result, with the holder element 16 of FIG. 6, the distance to the reveal wall 11 and the orientation with respect to the reveal wall 11 can be adjusted independently from each other.

For adjusting the orientation of the holder element 16 with respect to the reveal wall 11, adjustment means are provided in the form of set screws 40, 41, 42. These are located at the periphery of the holder element 16, namely at the periphery of the outer ring 18, i.e. as far as possible from the centre, where the fixing element 3 is located, so that the turning of the set screws has the largest possible effect. In order to obtain adjustability of the orientation around both a horizontal and a vertical axis (or both orthogonal axes enabled by the pivot 30), the set screws 40, 41, 42 are located at three spaced apart locations, more particularly on the corners of an equilateral triangle. Of course, set screws may also be provided on four or more spaced apart locations around the periphery of the outer ring 18 of holder element 16. In FIG. 6, this outer ring 18 has a circular shape, but this is not essential. The outer part of the holder element 16 may also be formed by a part with a triangular, rectangular, oval, square, pentagonal, hexagonal or any other shape which is deemed suitable by the person skilled in the art. In the embodiment of FIG. 6, the set screws 40-42 are socket screws whose length is substantially equal to the thickness of the outer ring 18, which has the advantage that in use no part of the screws 40-42 protrudes from the surface of the holder element 16. However, shorter or longer socket screws and other than socket screws may also be employed as set screws and other orientation adjustment means are also possible.

For attaching the frame part 6 to the holder element 16, the inner ring 17 has a plurality of threaded holes 43 spread over its surface for receiving attachment screws 7, 8. The number and location of the threaded holes 43 is such that there is always at least one hole 43 in a position suitable for attaching the frame part 6 at the desired distance with respect to the reveal wall 11. In the embodiment of FIG. 6, the holes 43 are located in pairs along diameters of the inner ring 17 which enclose regular angles with respect to each other. In the embodiment shown in FIG. 6, the angle is each time 20°. This ensures that the holder element 16 is in a suitable position for attaching the frame part 6 every 20° of a revolution around the fixing element 3. Of course, this angle may also be wider or narrower and need not be regular, and more or less holes 43 may be provided over the surface of the inner ring 17 of the holder element 16.

The circumference 47 of the inner ring 17 is provided with a plurality of notches 46, substantially equally spaced at the front of the circumference. These notches 46 are intended for accommodating a tool (not shown), by means of which the inner ring 17 can be rotated from the side of the mounting assembly 15. This is useful for example when a frame part 6 has been fixed to a reveal wall 11 using a number of mounting assemblies 15 and the distance to the reveal wall 11 is too short or too long at one of the mounting assemblies 15. The skilled person can then release the frame part 6 from this mounting assembly 15 by removing the attachment screws 7, 8, adjust the distance by rotating the inner ring 17 using the tool and the notches 46, and finally re-attach the frame part 6 to the mounting assembly 15 by re-inserting the attachment screws 7, 8. This shows that with the mounting assembly 15 there is no need to disassemble the whole for making such a final adjustment. Furthermore, by a rotation of the inner ring 17, also adjustments in height and width directions are enabled, since the rotation moves the holes 43 or makes different holes 43 available for receiving the screws 7, 8.

In an alternative embodiment (not shown), the holder element could also be formed by an inner part with set screws or other orientation adjusting elements and an outer part, which is in screw-like engagement with the inner part, with holes for receiving attachment screws or other attachment means. So in this alternative embodiment, the orientation adjusting means would be disposed inwardly from the attachment means. If in this alternative embodiment a fixing part 3 as shown in FIGS. 1 and 6 is used, the screw-like engagement between the inner part of the holder element and the outer concentric element 32 of the fixing part 2 could be dispensed with, i.e. the inner part and the outer concentric element could be constructed as a unitary piece.

Figure 7:
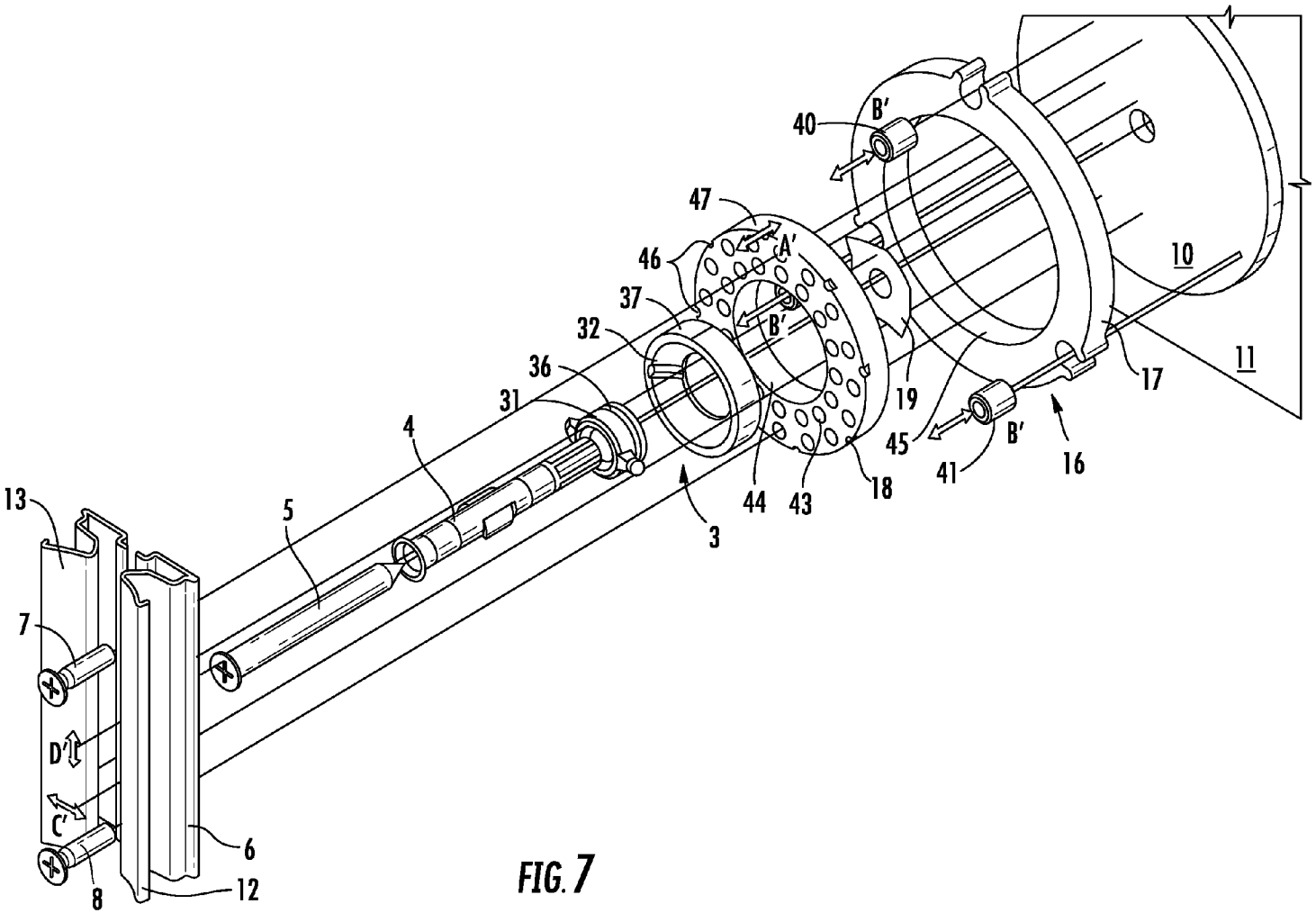
FIG. 7 shows an exploded view of the mounting assembly of FIG. 6.

The fixing of a frame part 6 to a reveal wall 11 using the mounting assembly 15 is clarified with reference to FIG. 7 as follows. First, a hole (not shown) is drilled in the reveal wall 11 for receiving the plug 4 and the fixing screw 5. The plug 4 is inserted into this hole while respectively mounting the inner concentric element 31, the outer concentric element 32, a resilient element 19 and one or more spacer elements 10 over the plug 5. The resilient element 19 functions to apply a spring force to the back of the outer concentric element 32 for maintaining contact between the sleeves 34 and the protrusions 35 during assembly. The number of spacer elements 10 which is mounted is varied according to the distance between the reveal wall 11 and the location where the frame part 6 is to be attached. It is preferred to mount at least one spacer element 10 in a resilient material for overcoming surface irregularities of the reveal wall 11, but if desired the spacer elements 10 can be dispensed with if the distance which can be bridged by rotating the inner ring 17 of the holder element 16 on the fixing element 3 is sufficient. The spacer element 10 is preferably constructed in a flexible material, so that the spacer element 10 not only functions as spacer but also for overcoming the surface irregularities on the reveal wall 11 and for damping vibrations, leading to a much more rigid attachment of the mounting assembly 15 to the reveal wall 11.

After the plug 5 has been inserted, the fixing screw 5 is screwed into the plug 4 until the head of the screw 5 is in contact with the front surface of the first concentric element 31, thereby fixing this element 31 and in turn the outer concentric element 32, the resilient element 19 and the spacer elements 10 (if any) to the reveal wall 11.

Figure 8:
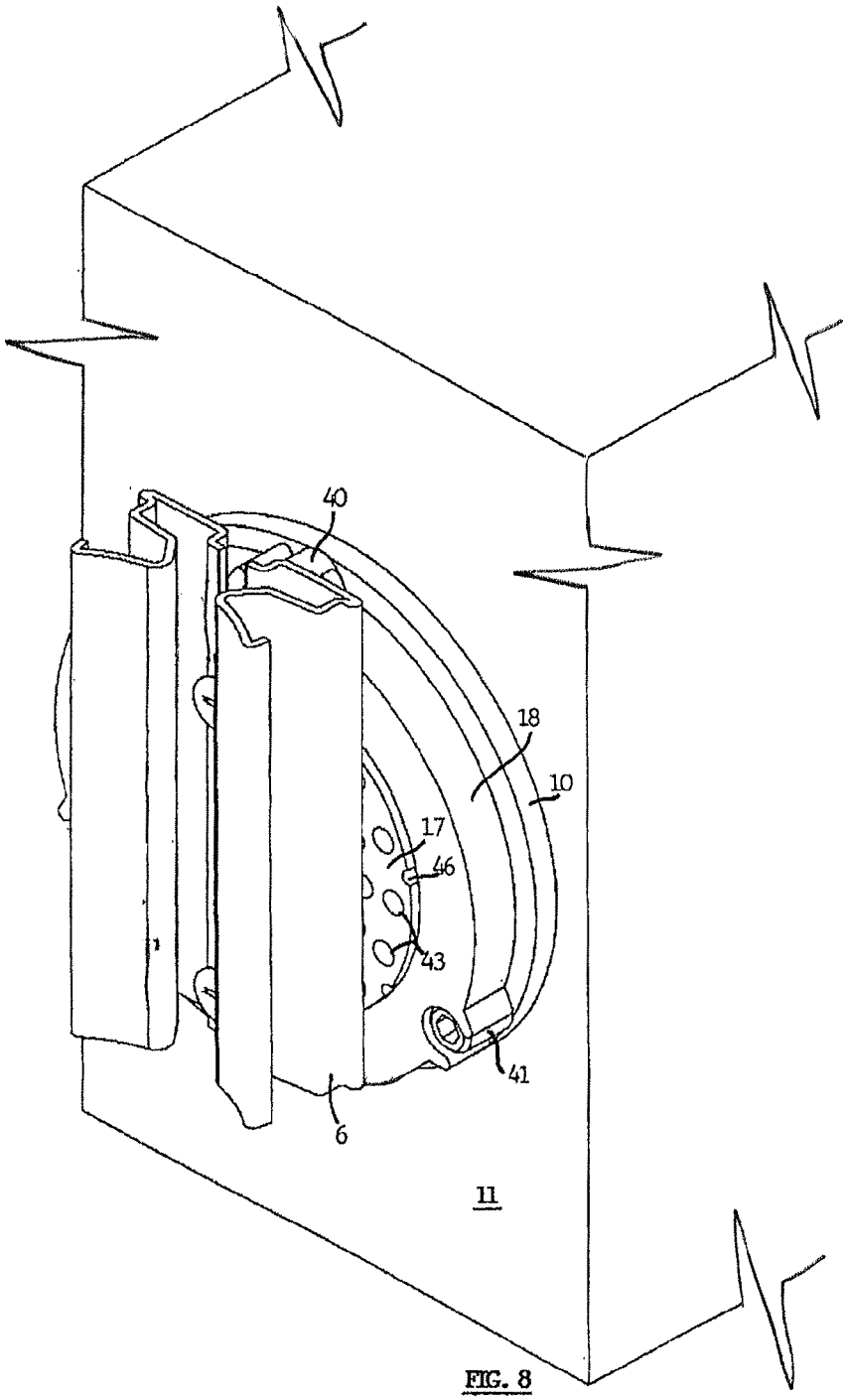
FIGS. 8, 9 and 10 respectively show a perspective view, a side view and a top view of a frame part fixed to a reveal wall by means of the mounting assembly of FIG. 6.

In a next step, the holder element 16 is placed by screwing it onto the outer concentric element 32. The rings 17 and 18 may be placed simultaneously or one after the other. In any case, the outer ring 18 is brought in contact or almost in contact with the foremost spacer element 10 (or the reveal wall 11 if no spacer elements 11 are used). Next, the set screws 40-42 are used to support the outer ring 18 on the foremost spacer element 10 (or the reveal wall 11) and to obtain the desired orientation. During this operation, the outer concentric element 32 of the fixing part 3 may be moved with respect to the inner concentric element 31 by tilting about the orthogonal pivot axes which are enabled by the pivot 30. Then, the inner ring 17 is rotated up to a position in which its front surface substantially corresponds to the location or distance from the reveal wall 11 at which the frame part 6 is to be mounted. Due to the opposite screw-like engagements, the rotation of the inner ring 17 can be done without affecting the position of the outer ring 18 or the previously set orientation. The desired distance between the front surface of the inner ring 17 and the reveal wall 11 and its orientation can be checked by means of any suitable measurement device known to the person skilled in the art. Finally the frame part 6 is attached to the inner ring 17 by means of one or more attachment screws 7, 8. The result is shown in FIGS. 8-10.

As shown in FIGS. 4 and 9, the frame part 6 comprises openings 14 for receiving the attachment screws 7, 8 of the mounting assembly 1, by means of which the frame part 6 is attached to the holder element 2. These openings 14 have a shape which enables a positional adjustment of the frame part 6 with respect to the holder element 2 of the mounting assembly 1 in height direction. They may furthermore be shaped such that also an adjustment in width direction is enabled. Furthermore, the adjustment in width direction can also be achieved by attaching the frame part 6 offset from the centre of the mounting assembly 1, 15, which is possible due to the plurality of holes 23, 43 which are provided over the surface of the holder element 2, 16, the rotatability of the holder element 2, 16 around the fixing element 3 and the shape of the openings 14 in the frame part 6. These three features together ensure that always at least one hole 23, 43 can be brought to a suitable position for attaching the frame part 6.

The frame part 6 is laterally provided with clamping members 12, 13. These are intended for holding other frame parts such as stiles (not shown), which close the door/window frame around the wall opening and conceal the mounting assemblies 1, 15, leading to an aesthetically pleasing appearance.

REFERENCE LIST

1 mounting assembly
2 holder element
3 fixing element
4 plug
5 fixing screw
6 frame reveal part
7 attachment screw
8 attachment screw
9 resilient element
10 spacer element
11 reveal wall
12 clamping member
13 clamping member
14 openings
15 mounting assembly
16 holder element
17 inner part
18 outer part
19 resilient element
20 set screw
21 set screw

22 set screw
23 screw holes
24 first threaded opening
30 pivot
31 inner concentric element
32 outer concentric element
33 central opening
34 opposite sleeves
35 ball-shaped protrusions
36 peripheral sleeve
37 first threaded circumference
40 set screw
41 set screw
42 set screw
43 screw holes
44 first threaded opening
45 second threaded opening
46 notches
47 second threaded circumference
50 wall plane
51 wall opening
52 floor
53 top wall

I claim:

1. Mounting assembly for adjustably mounting a door/window frame part onto a wall, wherein the mounting assembly comprises a holder element having a plurality of attachment means on which the frame part is attachable and a plurality of adjustment means for adjusting the orientation of the holder element with respect to the wall, and a single location fixing element for fixing the holder element to the wall, such that the holder element is fixed to the wall only at a single location, the fixing element comprising a pivot which enables the holder element to pivot with respect to the wall, wherein the plurality of adjustment means are located at least three spaced apart locations at the periphery of the holder element and the single location fixing element is located substantially in the centre of the holder element.

2. Mounting assembly according to claim 1, wherein the plurality of adjustment means are located at the corners of an equilateral triangle of which the centre substantially corresponds to the location of the fixing element.

3. Mounting assembly according to claim 1, wherein the plurality of adjustment means are formed by socket screws whose length is substantially equal to the thickness of the holder element.

4. Mounting assembly according to claim 1, wherein the fixing element comprises inner and outer concentric elements, the inner concentric element being provided for accommodating a plug with a fixing screw for fixing the inner concentric element to the wall and the outer concentric element being provided for engaging the holder element, the pivot of the fixing element being formed by a pair of sleeves in a first of the inner and outer concentric elements on opposite sides of the first concentric element and a pair of ball-shaped protrusions on a second of the inner and outer concentric elements on opposite sides of the second concentric element, the ball-shaped protrusions being slidably held in the sleeves.

5. Mounting assembly according to claim 1, wherein the holder element has an inner part which comprises the plurality of attachment means and which movably engages the fixing element in such a way that the inner part enables an adjustment in distance towards the wall.

6. Mounting assembly according to claim 5, wherein the inner part of the holder element has a first threaded circular opening and wherein the fixing element has a complementary first threaded circumference for effecting a first screw-like engagement between the inner part and the fixing element.

7. Mounting assembly according to claim 6, wherein the holder element comprises an outer part which comprises the plurality of adjustment means, the inner and outer parts together forming a unitary piece.

8. Mounting assembly according to claim 6, wherein the holder element comprises an outer part which comprises the plurality of adjustment means and has a second threaded circular opening, the inner part being formed by a ring in which the first threaded circular opening for engaging the fixing element is provided and which has a second threaded circumference complementary to the second threaded circular opening for effecting a second screw-like engagement between the outer and inner parts of the holder element, and wherein the first screw-like engagement is substantially opposite to the second screw-like engagement.

9. Mounting assembly according to claim 1, wherein the mounting assembly further comprises one or more spacer elements made of a flexible material for placement between the holder element and the wall.

10. Frame assembly comprising a door/window frame part and a mounting assembly for adjustably mounting the frame part onto a wall, wherein the mounting assembly comprises a holder element having a plurality of attachment means on which the frame part is attachable and a plurality of adjustment means for adjusting the orientation of the holder element with respect to the wall, and a single location fixing element for fixing the holder element to the wall, such that the holder element is fixed to the wall only at a single location, the fixing element comprising a pivot which enables the holder element to pivot with respect to the wall, wherein the plurality of adjustment means are located at least three spaced apart locations at the periphery of the holder element and the single location fixing element is located substantially in the centre of the holder element.

11. Frame assembly according to claim 10, wherein the plurality of adjustment means are located at the corners of an equilateral triangle of which the centre substantially corresponds to the location of the fixing element.

12. Frame assembly according to claim 10, wherein the plurality of adjustment means are formed by socket screws whose length is substantially equal to the thickness of the holder element.

13. Frame assembly according to claim 10, wherein the fixing element comprises inner and outer concentric elements, the inner concentric element being provided for accommodating a plug with a fixing screw for fixing the inner concentric element to the wall and the outer concentric element being provided for engaging the holder element, the pivot of the fixing element being formed by a pair of sleeves in a first of the inner and outer concentric elements on opposite sides of the first concentric element and a pair of ball-shaped protrusions on a second of the inner and outer concentric elements on opposite sides of the second concentric element, the ball-shaped protrusions being slidably held in the sleeves.

14. Frame assembly according to claim 10, wherein the holder element has an inner part which comprises the plurality of attachment means and which movably engages the fixing element in such a way that the inner part enables an adjustment in distance towards the wall.

15. Frame assembly according to claim 14, wherein the inner part of the holder element has a first threaded circular opening and wherein the fixing element has a complementary first threaded circumference for effecting a first screw-like engagement between the inner part and the fixing element.

16. Frame assembly according to claim 15, wherein the holder element comprises an outer part which comprises the plurality of adjustment means, the inner and outer parts together forming a unitary piece.

17. Frame assembly according to claim 15, wherein the holder element comprises an outer part which comprises the plurality of adjustment means and has a second threaded circular opening, the inner part being formed by a ring in which the first threaded circular opening for engaging the fixing element is provided and which has a second threaded circumference complementary to the second threaded circular opening for effecting a second screw-like engagement between the outer and inner parts of the holder element, and wherein the first screw-like engagement is substantially opposite to the second screw-like engagement.

18. Frame assembly according to claim 10, wherein the mounting assembly further comprises one or more spacer elements made of a flexible material for placement between the holder element and the wall.

19. Frame assembly according to claim 10, wherein the frame part comprising openings for receiving the attachment means of the mounting assembly, the openings having a shape which enables a positional adjustment of the frame part with respect to the holder element of the mounting assembly in a height direction and/or in a width direction of the frame part.

* * * * *